United States Patent [19]

Fox

[11] 4,064,819

[45] Dec. 27, 1977

[54] MACHINE FOR PROGRESSIVELY CLOSING FLANGES OF CAP STRIPS ON STANDING T-RIB ROOFS

[75] Inventor: John F. Fox, Riverdale, Ga.

[73] Assignee: Atlanta Metal Products, Inc., Atlanta, Ga.

[21] Appl. No.: 774,104

[22] Filed: Mar. 3, 1977

[51] Int. Cl.[2] ..... B21D 37/00

[52] U.S. Cl. ..... 113/55; 29/243.58; 72/DIG. 1; 113/57

[58] Field of Search ..... 113/54, 55, 57, 58; 72/48, 121, DIG. 1; 29/243.5, 243.57, 243.58

[56] References Cited

U.S. PATENT DOCUMENTS

| | | | |
|---|---|---|---|
| 2,635,332 | 4/1953 | Huntington | 113/58 X |
| 2,903,988 | 9/1959 | Engel | 113/57 |
| 3,771,482 | 11/1973 | Thompson | 113/55 |
| 3,797,430 | 3/1974 | Boudreau | 113/55 |
| 4,027,611 | 6/1977 | Ward et al. | 113/58 X |

*Primary Examiner*—Leon Gilden

*Attorney, Agent, or Firm*—Newton, Hopkins & Ormsby

[57] ABSTRACT

A self-propelled roof T-rib cap flange closing or seaming machine has a base with guidance means to travel along the top of the cap strip. Cap strip closing dies on opposite sides of the machine having crowned tops and angled flange engaging leading faces are oscillated vertically about their rearward ends by drive motor and eccentric cam means on the machine. The crowned tops of the dies react against the formed flanges of the cap strip to advance the machine longitudinally of the standing rib for progressively closing said flanges.

10 Claims, 9 Drawing Figures

MACHINE FOR PROGRESSIVELY CLOSING FLANGES OF CAP STRIPS ON STANDING T-RIB ROOFS

BACKGROUND OF THE INVENTION

A need exists for a more efficient and less costly machine to close or seam the side flanges of cap strips on standing T-rib metal roofs. Ideally, a machine for this purpose should be self-propelling, reasonably rapid in operation and easy to place into operating engagement with the roof T-rib and removed therefrom. The machine should also be very sturdy and durable and without a multitude of adjustments to interfere with the consistent performance of the machine. These and other attributes are thought to be present in this invention.

More particularly, the present invention incorporates a unique and simplified arrangement of closing dies for the cap strip side flanges which progressively fold the flanges about the crown plates of the standing T roof rib. The dies are uniquely shaped to engage the closed cap strip flanges during their oscillatory movement and provide a type of friction drive for the machine along the T-rib without other driving assistance. The arrangement is very simple and very effective. The machine also embodies a quick release lever arrangement whereby the two flange closing dies may be spread apart laterally at any time to release the machine from the standing T-rib or to reset it for further flange closing activity.

Other features and advantages of the invention will become apparent during the course of the following description.

DETAILED DESCRIPTION

Figure 1:
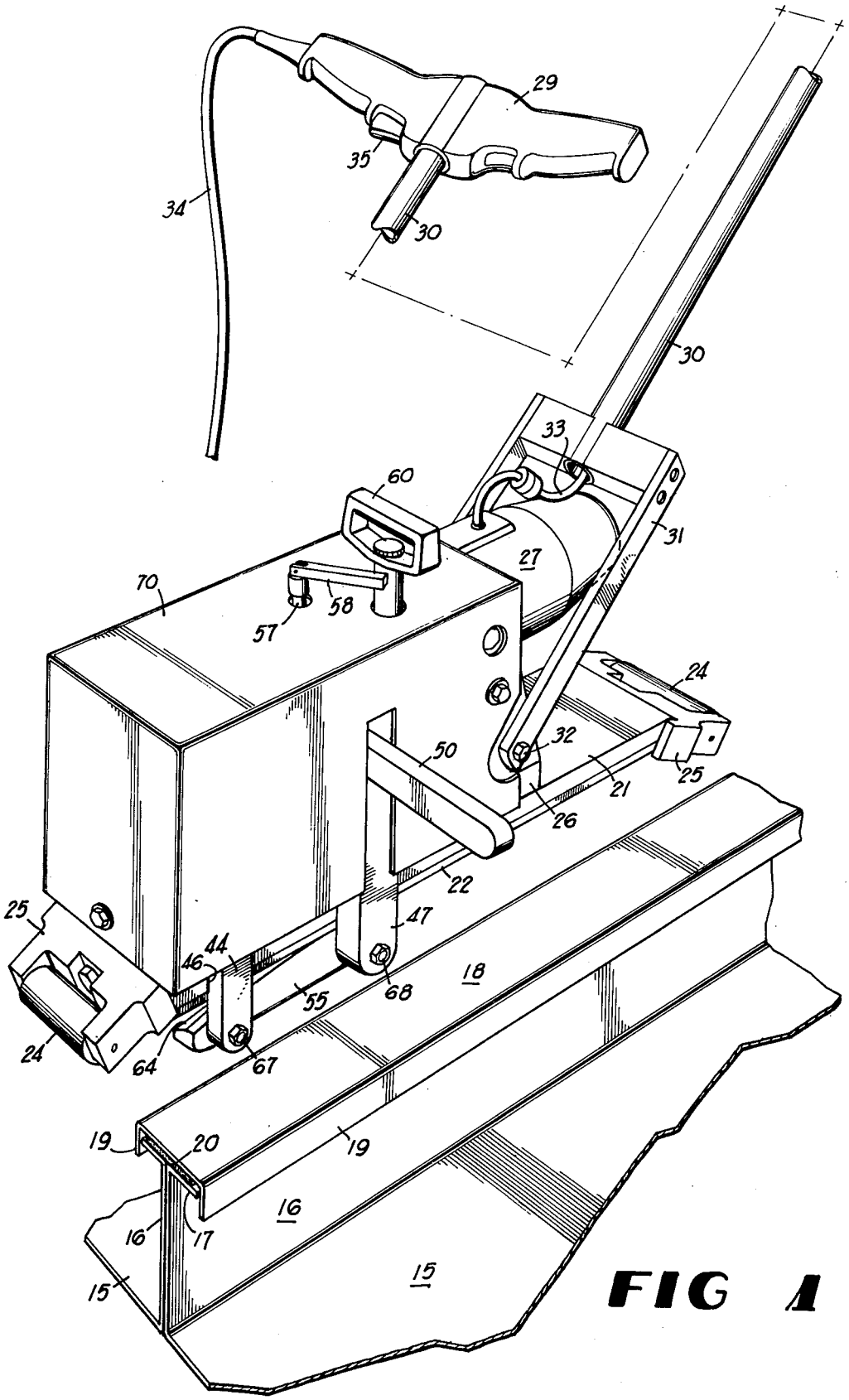
FIG. 1 is a perspective view of the invention shown above a roof T-rib whose cap strip side flanges have not yet been closed around the crown plates of the rib.
Figure 5:
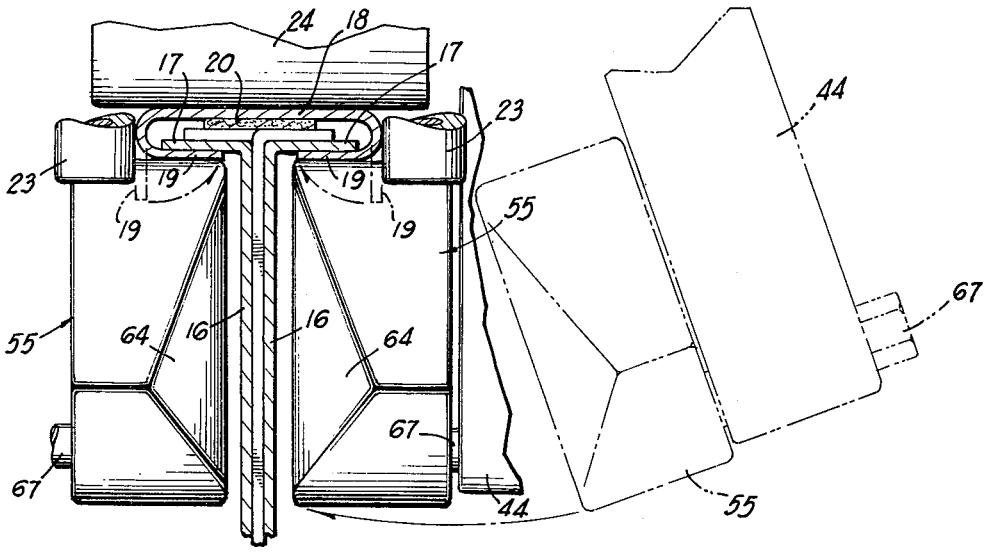
FIG. 5 is an enlarged fragmentary front elevational view of the dies and associated guide elements in the act of closing or forming cap strip side flanges around the crown plates of a roof T-rib.

Referring to the drawings in detail wherein like numerals designate like parts, reference is made first to FIG. 1 showing the machine of the invention in its entirety in relation to a standing T-rib metal roof having adjacent panels 15, each panel having an upstanding flange 16 for abutment with the like flange of the next roof panel to form a standing T-rib between the panels. Each T-rib has a pair of top horizontal crown flanges or plates 17 formed integrally with the upstanding flanges 16 and projecting outwardly thereof at right angles thereto. A channel cross-section cap strip 18 having depending side flanges 19 is placed atop each standing T-rib and is coextensive lengthwise therewith. Preferably, a mastic seal strip 20 is placed between the cap strip 18 and the crown plates of the T-rib for sealing the roof. The purpose of the invention, now to be described, is for engaging and progressively closing the cap strip side flanges 19 around and under the crown plates 17, as shown in FIG. 5, to complete the construction of the T-rib in a highly consistent or uniform manner, without irregularities or defects in the work.

The machine proper embodying the invention comprises an elongated base plate 21 preferably having a teflon skid plate 22 secured to its bottom side, the skid plate carrying fore and aft laterally spaced pairs of vertical axis machine guide rollers 23 adapted to straddle the cap strip or plate 18 during the operation of the machine for guiding the machine lengthwise of the standing T-rib during the flange closing operation. Additionally, the base plate 21 carries fore and aft transverse axis support rollers 24 which roll along the top of the cap plate 18 during the operation of the machine. The rollers 24 are journaled in sturdy support yokes 25 suitably fixed on the base plate 21.

Toward the rear end portion of the base plate 21, a sturdy motor mount 26 is fixedly secured thereto and rises thereabove. A suitable electric motor 27 having a horizontal armature shaft is supported between the sides of the mount 26 by trunnion elements 28. A pushing and manipulating handle 29 having an inclined shaft 30 is connected by a handle yoke 31 to the sides of the motor mount 26 as by clevis pins 32. A power cable 33 for the motor 27 extends along or through the handle shaft 30 and suitable receptacle means in one end of the handle 29 electrically connected with the cable 33 receives a cable extension 34 of any necessary length leading to a source of 110 volt AC power. The handle 29 has a trigger switch 35 for controlling the operation of the motor 27 in much the same manner that the motors of electric lawn mowers and the like are controlled. All of the electrical means are conventional.

Forwardly of the drive motor 27, a drive shaft extension 36 is coupled at 37 with the motor armature shaft so as to be directly driven by the latter. The drive shaft extension 36 is journaled near the forward end of the base plate 21 on spaced sturdy bearing supports 38 rigidly anchored to the base plate as at 39. Between the bearing suports 38, the shaft 36 carries an eccentric cam 40 which rotates inside of a horizontally oblong opening 41 of a vertically reciprocating cam follower block or plate 42. A pair of transverse bars 43 are fixed to opposite sides of the cam follower block 42 to rise and fall therewith, and a pair of vertically shiftable die actuating arms 44 are pivotally connected by elements 45 at their tops to the bars 43 of reciprocating block 42. Thus, the actuating arms 44 reciprocate vertically with the block 42 and may be guided in their vertical movement by side grooves 46 in the base plate 21. The arms 44 are also swingable laterally of the base plate 21 around the axes of pivot elements 45 between their active use vertical positions in FIG. 3 and separated inclined positions shown in FIGS. 4 and 5. The latter spread or separated positions allow the machine to be engaged with the standing T-rib or separated therefrom, as will be further described.

A cooperating pair of die support arms or links 47 is arranged rearwardly of the actuating arms 44 and the arms 47 are pivotally supported on the base plate 21 by horizontal axis pivot means 48 at the same elevation and coaxial with the pivot means 45 of the actuating arms 44. Thus, the pairs of arms 44 and 47 may swing in unison from their vertical positions to their spread apart positions at proper times. When vertically disposed, the die support arms 47 are also received in side notches 49 of the base plate 21.

Figure 2:
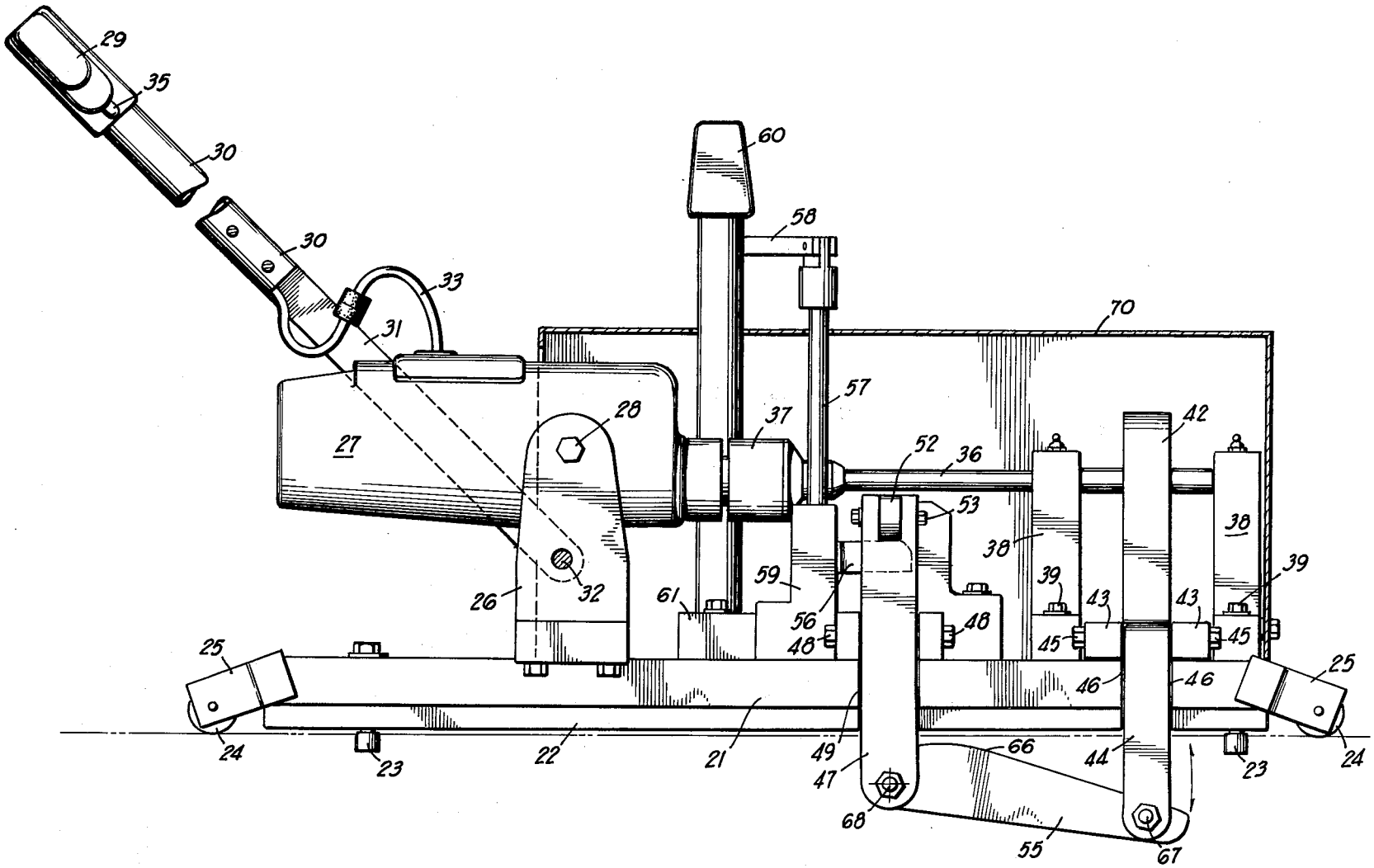
FIG. 2 is a side elevational view of the invention partly in section and partly broken away.
Figure 3:
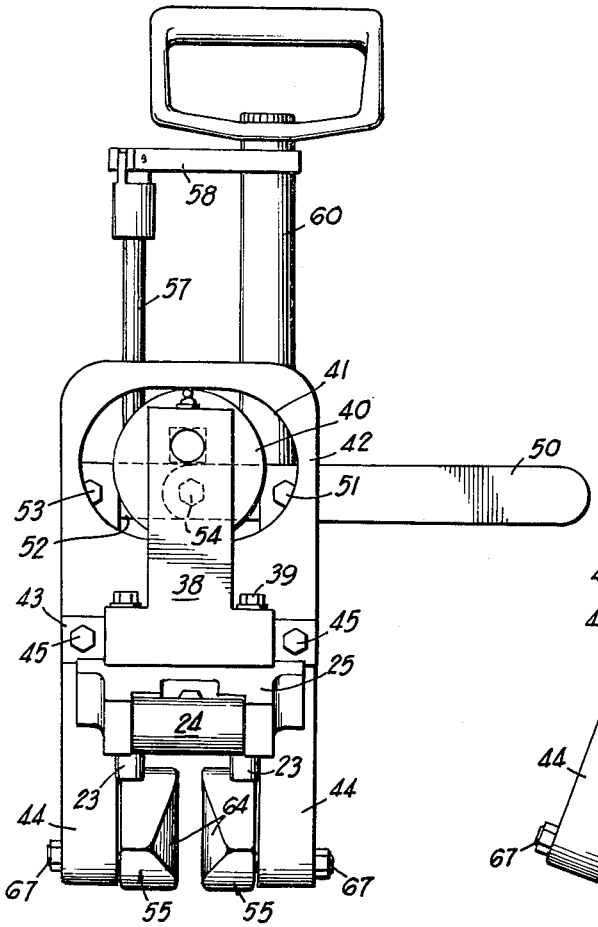
FIG. 3 is a front elevational view of the invention in FIG. 2 with the housing removed and showing the flange closing dies in their active positions.
Figure 4:
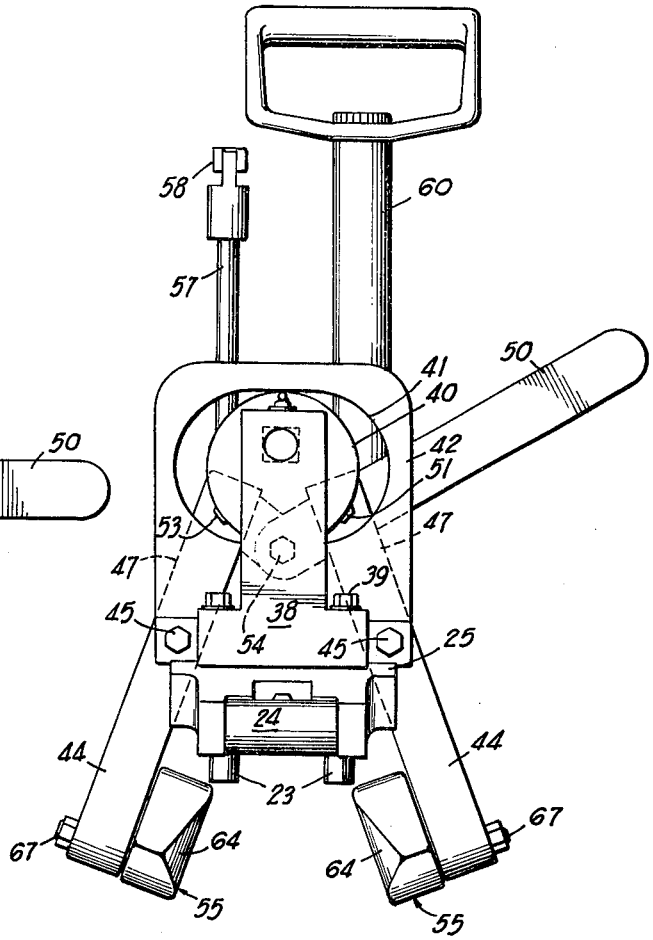
FIG. 4 is a view similar to FIG. 3 showing the dies spread apart to allow the machine to be removed from or engaged with a T-rib.
Figure 6:
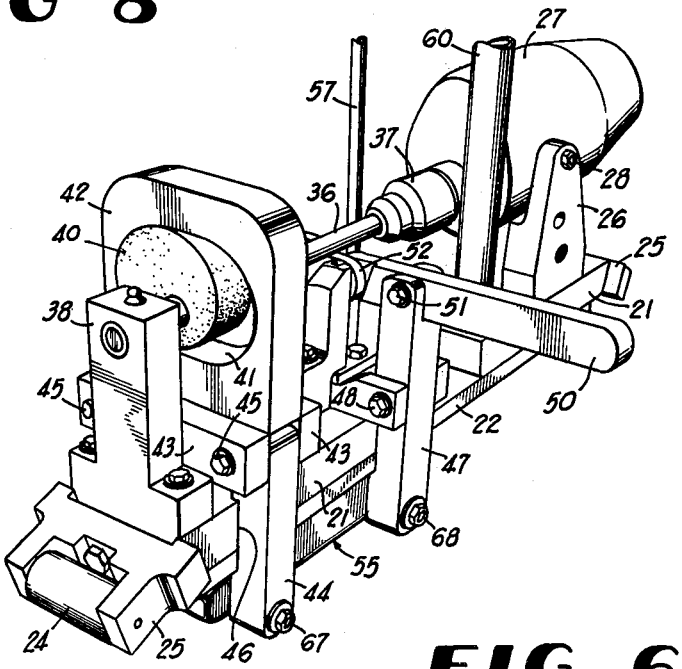
FIG. 6 is a perspective view of the machine with the housing removed.

In order to quickly and conveniently swing the pairs of arms 44 and 47 to and from their separated inclined positions, a laterally extending vertically swingable manual lever 50 is provided on the machine and pivotally connected at an intermediate point thereon as at 51 with the top of one support arm 47. A short toggle link 52 is pivotally connected at 53 with the top of the opposite arm 47 and is also pivotally connected by a pivot element 54 with the interior end of the lever 50. This pivot element 54 has a projecting follower lug 54L which is guided in a vertical slot 54S in a guide block 54B as viewed from FIGS. 2, 4 and 6. In this fashion the pivot element 54 is guided in a vertical path to thereby spread the arms 44 and 47 equally from their closed position (FIG. 3) to their open position (FIG. 4). The arrangement forms a simple break or toggle joint between the vertically swingable lever 50 and the tops of the support arms 47, as best shown in dotted lines in FIG. 4. When the lever 50 is elevated, the pivot element 54 will descend and the two arms 44 will have their lower arms swung equally outwardly to the inclined separated positions as shown in the drawings. When the lever 50 is returned to a level position, the arms 47 will be returned to their vertical parallel positions as shown in FIGS. 3 and 6. The arms 47, during this movement, will swing on their pivots 48. The arms 44 will simultaneously follow the swinging movement of the arms 47 and swing on their independent pivots 45 due to being connected with the arms 47 by the rigid dies 55, now to be described.

Preferably, the machine has a means to lock the lever 50 in the horizontal position, FIG. 3, with the pairs of arms 47 and 44 parallel and vertical, so that the arms and flange closing dies 55 cannot spread apart at improper times while the machine is moving along the standing T-rib. This means comprises a simple rotary lug 56, FIG. 2, operated by a vertical shaft 57 having an upper handle 58, the shaft 57 being journaled in a bearing block 59 fixed to the base plate 21. When the handle 58 is turned in the proper direction, the lug 56 will swing beneath the break joint pivot 54 so that the lever 50 cannot be elevated and the dies 55 cannot be separated. At this time, the rotary handle 58 lies in contact with the side of a vertical lifting and carrying handle 60 for the entire machine which is firmly attached through a block 61 to the base plate 21 near the longitudinal center thereof. When the handle 58 is turned away from the fixed handle 60, the lug 56 will swing out from under the pivot 54 so that the lever 50 can be elevated for swinging the dies 55 apart.

Figure 7:
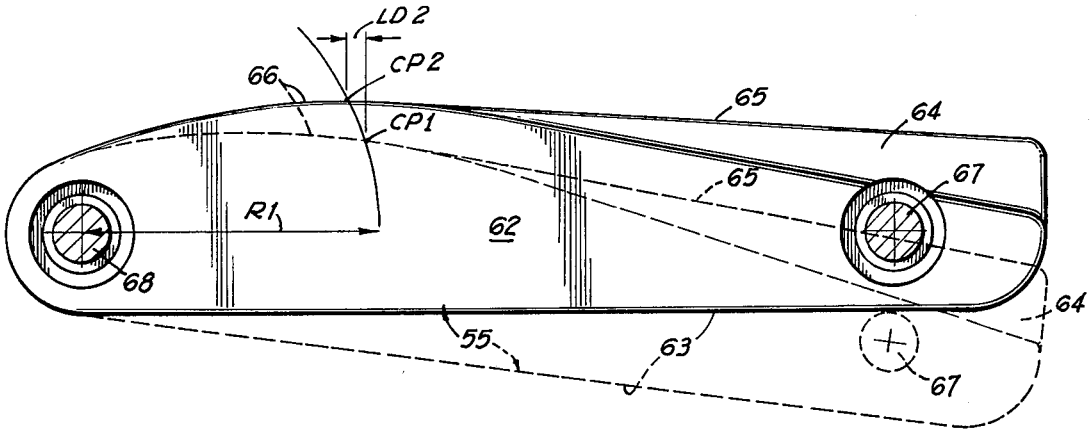
FIG. 7 is a side elevation of one die.
Figure 8:
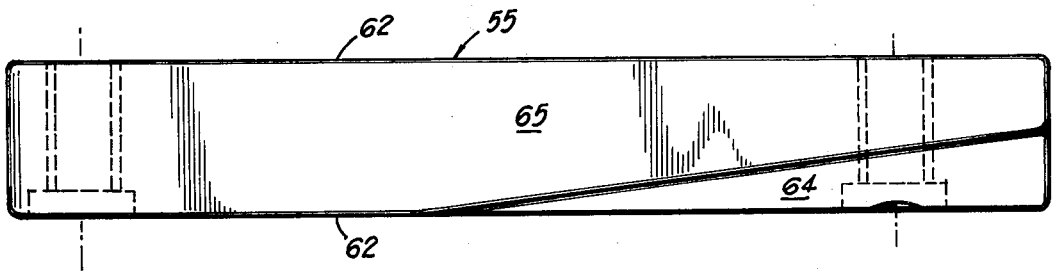
FIG. 8 is a plan view thereof.
Figure 9:
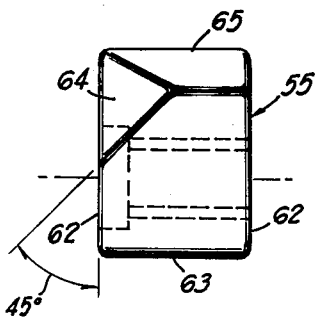
FIG. 9 is a leading end elevation of the die in FIG. 8.

The dies 55 are important and unique elements of the invention and since they are identical in construction, a detailed description of one will serve to describe both. Each die 55 is an elongated rigid member having vertical side faces 62 and a straight bottom face 63. Beginning at the leading end and top of each die, a flat angled face 64 extends rearwardly and gradually blends into one side face and into the top face of the die as best shown in FIG. 7. The angled face 64 is preferably disposed at 45° to the vertical, as best shown in FIG. 9.

The top face 65 of each die diverges somewhat rearwardly from the straight bottom face 63 and toward its rear end each die has a crowned arcuate top face portion 66 which is rather gradually curved on a large radius. It is this crowned surface portion of the die which contacts the bottoms of the closed flanges 19, FIG. 5, to propel the machine gradually along the standing T-rib due to the oscillatory movement of the two dies induced by the cam 40 and associated elements.

Each die 55 near its leading end is pivotally connected by a pivot element 67 with the lower end of one die actuating link 44. Similarly, each die is pivotally connected near its rear end by another pivot element 68 with the lower end of one of the die support arms 47. The dies 55 are disposed at the inner sides of the pairs of arms 44 and 47 and project inwardly of these arms, FIGS. 3 and 5, so that the opposing dies may lie close to the vertical flanges 16 of the standing T roof rib and under the crown plates 17 of the rib when the lever 50 is level and the arms 44 and 47 are vertical and parallel. As explained, when the lever 50 is raised, the dies 55 separate, FIG. 4, so that the machine can be disengaged from the standing T-rib. The machine has a box-like removable cover or housing 70 to enclose the moving parts above the base plate 21.

When initiating the operation of the machine at one end of a roof rib, the side flanges 19 of the cap plate or strip 18 are vertical and in straddling relationship to the crown plates 17. The leading roller 24 can be placed on top of the cap strip 18 and by utilizing the handle 29, the inclined die faces 64 can be forced under the vertical flanges 19 of the cap strip to start the inward folding or closing thereof around and under the crown plates 17. With the drive motor 27 in operation, as soon as the machine is manually advanced a few inches, the crowns 66 of the dies 55 will begin to engage the bottoms of the closed portions of the flanges 19, FIG. 5, which are now horizontally disposed under the crown plates 17 of the standing T-rib. From this point forwardly, the continuous oscillatory movement of the dies 55 caused by the action of the eccentric cam 40 and vertical reciprocation of the block 42 and arms 44 will advance the machine automatically along the cap strip 18 to progressively fold under and close the flanges 19 around the crown plates 17 of the roof rib. The crowns 66 of the two dies act on the closed flanges 19 to pull the machine longitudinally forwardly a small amount on each oscillation of the dies around their pivots 68. The arrangement amounts to a self-induced friction drive for the machine along the standing T-rib of the roof. The driving action can be better understood by reference to FIG. 7, wherein the radius $R_1$ from the rear pivot 68 of the die defines an arc 69 which intersects the high point of the crown 66 at points CP1 and CP2 for the down and up positions of the die 55. It can be seen that a linear distance LD2 exists between the two intersecting points CP1 and CP2 and this is the distance that, upon each oscillation of the dies 55, the machine will be advanced longitudinally forwardly, as described.

Consequently, once the operation of the machine in closing the cap strip flanges 19 is established, the machine will continue to advance itself along the cap strip in the described manner and at the proper speed to progressively close the flanges 19 in a most efficient manner. During such progress, the fore and aft rollers 24 continue to travel on top of the cap strip 18 and the rollers 23 continue to guide the machine so that it will not wander laterally.

As explained, the angled die faces 64 begin the folding under of the vertical flanges 19 and gradually these flanges are passed by the angled faces and begin to engage the top faces of the two dies as depicted in FIG. 5 so that finally the moving dies force the flanges 19 to their fully closed positions beneath the crown plates 17.

The machine is characterized by simplicity, compactness, convenience of use, efficiency of operation, and comparative economy of manufacturing cost. Its many advantages should now be apparent to those skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A machine for progressively closing cap strip side flanges on a standing T-rib comprising a base plate, means on the base plate to guide the machine longitudinally of a standing T-rib, power means on the base plate including a rotary eccentric element, a follower engaging the rotary eccentric element and being reciprocated thereby substantially normal to the base plate, a pair of cap strip side flange closing dies disposed below the base plate in laterally spaced relationship, forward and rear suspension arms for the dies pivoted thereto and also being pivotally mounted relative to the base plate for lateral swinging with the dies so that the dies may assume separated inclined positions and side-by-side substantially vertical positions, and said forward suspension arms being coupled to said follower and reciprocated thereby to cause oscillation of the dies about their rear pivoted ends.

2. A machine as defined in claim 1, and a manual operator coupled with at least one pair of said suspension arms to swing the arms to and from said separated and side-by-side positions.

3. A machine as defined in claim 1, and said dies being elongated and each having a forward end and outer side angled face to initiate closing of cap strip side flanges, and each die having a top side arcuate crown rearwardly of its angled face frictionally engaging closed cap strip side flanges during the oscillation of said dies to progressively advance the machine lengthwise of a standing T-rib.

4. A machine as defined in claim 1, and said means on the base plate to guide the machine comprising a pair of fore and aft transverse axis rollers on opposite ends of the base plate to roll on top of a cap strip, and fore and aft laterally spaced pairs of vertical axis guide rollers on the base plate to straddle a cap strip and engage same to guide the machine therealong.

5. A machine as defined in claim 1, and said power means comprising a motor on said base plate having a drive shaft above and substantially parallel to the base plate, said rotary eccentric element being carried by said drive shaft, said follower being a block-like member having an opening receiving the eccentric element, said forward suspension arms for said dies pivotally attached to said follower and said rear suspension arms pivotally attached to the base plate, and the pivotal axes of the forward and rear suspension arms being normal to the axes of the pivots of said dies with said suspension arms.

6. A machine as defined in claim 2, and said manual operator comprising a lever on said machine pivoted to one suspension arm above the pivotal mounting thereof to the base plate, and a toggle link interconnecting said lever and the opposing suspension arm above the pivotal mounting thereof, whereby swinging of the lever in a vertical plane will shift said dies between said separated inclined and said side-by-side vertical positions.

7. A machine as defined in claim 6, and a manually shiftable element on the machine movable into disabling relationship with the lever and toggle link to thereby lock said dies in said side-by-side positions.

8. A machine as defined in claim 5, and a manipulating handle for said machine, a mounting means for said motor on said base plate, and the manipulating handle being pivoted to the motor mounting means.

9. A machine as defined in claim 8, and a separate rigid upright lifting handle for the machine on said base plate near the center of mass of the machine.

10. A machine as defined in claim 1, and said forward suspension arms pivotally attached at their tops and above the base plate with said follower, said base plate having side guide grooves for the forward suspension arms causing them to reciprocate with the follower substantially normal to the base plate.

* * * * *